United States Patent [19]

Schueler

[11] 4,072,346

[45] Feb. 7, 1978

[54] SEATING FURNITURE

[76] Inventor: Ralf Schueler, Gabrielenstrasse 66, 1000 Berlin 27, Germany

[21] Appl. No.: 577,441

[22] Filed: May 14, 1975

[30] Foreign Application Priority Data

May 17, 1974 Germany ..... 2424134

[51] Int. Cl.[2] ..... A47C 7/62

[52] U.S. Cl. ..... 297/217; 297/163; 297/232

[58] Field of Search ..... 297/331, 335, 336, 47, 297/163, 217, 191, 301, 232, 248, 249

[56] References Cited

U.S. PATENT DOCUMENTS

| | | | |
|---|---|---|---|
| 389,807 | 9/1888 | Haney | 297/331 X |
| 1,522,406 | 1/1925 | Bargen | 297/331 |
| 2,164,918 | 7/1939 | Hard | 297/331 |
| 2,378,495 | 6/1945 | Nordmark | 297/331 |
| 2,498,106 | 2/1950 | Elleman | 297/301 |
| 2,865,438 | 12/1958 | Machielse et al. | 297/217 |
| 2,973,028 | 2/1961 | Celeste | 297/163 |
| 3,007,736 | 11/1971 | Watlington | 297/217 |
| 3,019,050 | 1/1962 | Spielman | 297/217 |
| 3,336,076 | 8/1967 | Malitte | 297/163 X |
| 3,628,829 | 12/1971 | Helig | 297/217 |
| 3,655,239 | 4/1972 | Agosti | 297/331 |
| 3,762,766 | 10/1973 | Barecki | 297/331 |
| 3,795,422 | 3/1974 | Robinson | 297/191 |
| 3,865,430 | 2/1975 | Tanus | 297/217 |
| 3,893,729 | 7/1975 | Sherman | 297/232 |

*Primary Examiner*—James T. McCall

*Attorney, Agent, or Firm*—W. G. Fasse; W. W. Roberts

[57] ABSTRACT

The present seating furniture comprises chairs, especially constructed for multi-purpose group seating arrangements for example, in auditoriums, assembly halls, convention halls, lecture rooms and the like. The foldable seat proper is secured to the side walls of a shell shaped center part which in turn is supported by a base to which the shell shaped center part is removably connected. The shell shaped center part has a rear wall, the upper end of which is permanently connected to head rest means, if such head rest means are employed. Further, the side walls may be provided with telescoping means so that the side walls and the seat along with the corresponding portion of the back rest may be extended or retracted. In a modification one chair may be converted into a desk for the chair behind the converted chair.

32 Claims, 8 Drawing Figures

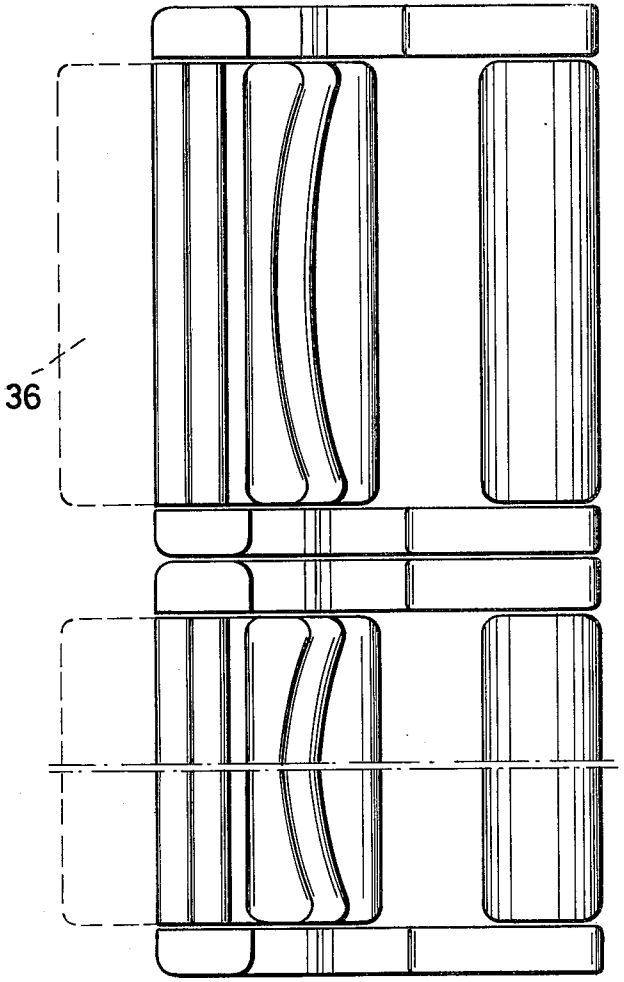
Fig. 2
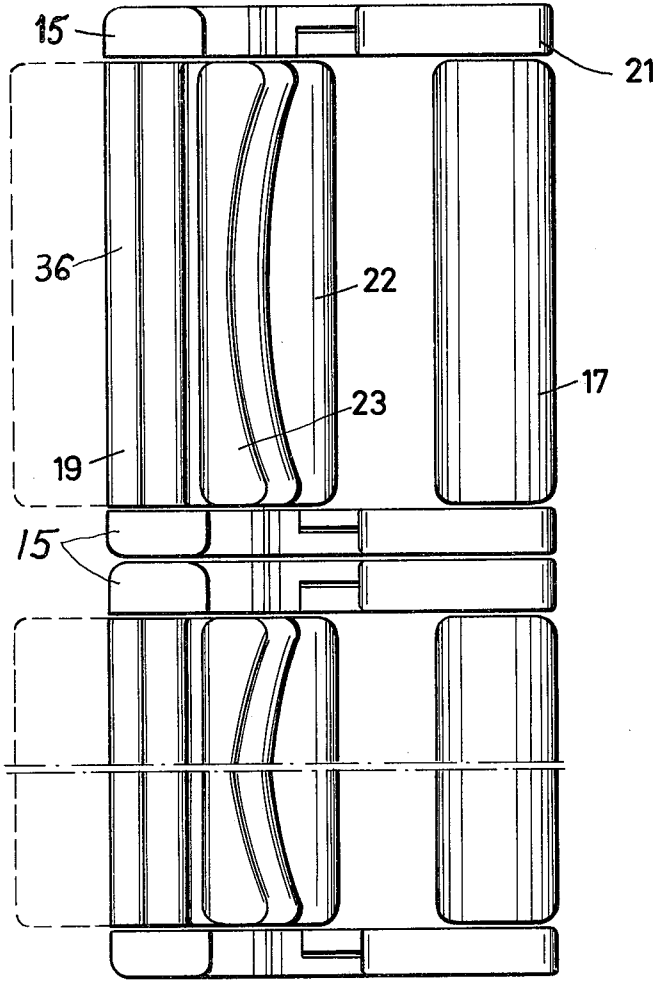

SEATING FURNITURE

BACKGROUND OF THE INVENTION

The present invention relates to seating furniture of the type employed in assembly halls, lecture halls, and the like. More specifically, the invention relates to seating arrangements which may be used for a plurality of purposes.

Chains and seating furnitures are known in the art which are suitable mostly for a single purpose. Thus, chairs are known which may be stacked one on top of the other for storage purposes and which may be arranged in groups for seating a large number of people. Further, chairs are known which are designed for special purposes, for example, to seat passengers in commercial vehicles such as railroad trains and passenger aircrafts.

OBJECTS OF THE INVENTION

It is the aim of the invention to achieve the following objects singly or in combination:

to construct a seating furniture in such a manner that from a single basic form modifications are easily made for adapting the seating furniture to different uses;

to construct the seating furniture so that with a minimum of exchangeable basic elements and/or with the use of additional elements the seating furniture may be adapted for a variety of purposes;

to construct each individual chain in such a manner that a number of chairs may be combined into portable or transportable units;

to construct these chairs in such a manner that they may be combined into seating arrangements on rearwardly rising floor spaces; and to combine at least two chairs into a grouping having a front chair and a rear chair, whereby the front chair may be easily modified into a desk for the rear chair.

SUMMARY OF THE INVENTION

According to the invention there is provided a seating furniture having base means, a back rest and foldable seat means, wherein a shell shaped center part having an upper end and a lower end extends into lateral side wall means either connected to the shell shaped center part or forming an integral structure with the center part. The lower end of the shell shaped center part is supported by the base and the seat means are foldably secured by respective support means to the side wall means. The shell shaped center part is releasably secured to the base means and the back rest means are permanently secured to the upper end of the center part.

According to a modified embodiment of the invention two chairs, namely, a front chair and a rear chair form a group, whereby the front chair comprises means for converting the front chair into a desk unit for the rear chair.

Preferably, the center part is provided with two lateral columns which may be somewhat slanted or extend substantially vertically whereby the center part is connected to these columns along both sides of the center part and whereby the side walls are also connected to the columns to form an integral structure. The center part itself may form the back rest. In the alternative, a head rest may be secured to the back rest to form an extension of the back rest, whereby the head rest would preferably have the same configuration, especially the same cross sectional configuration as the back rest. The side walls may be extendable.

BRIEF FIGURE DESCRIPTION

In order that the invention may be clearly understood, it will now be described, by way of example, with reference to the accompanying drawings, wherein:

FIG. 2 illustrates a top plan view of a seating arrangement according to the invention with the chairs arranged in rows and columns;

Figure 1:
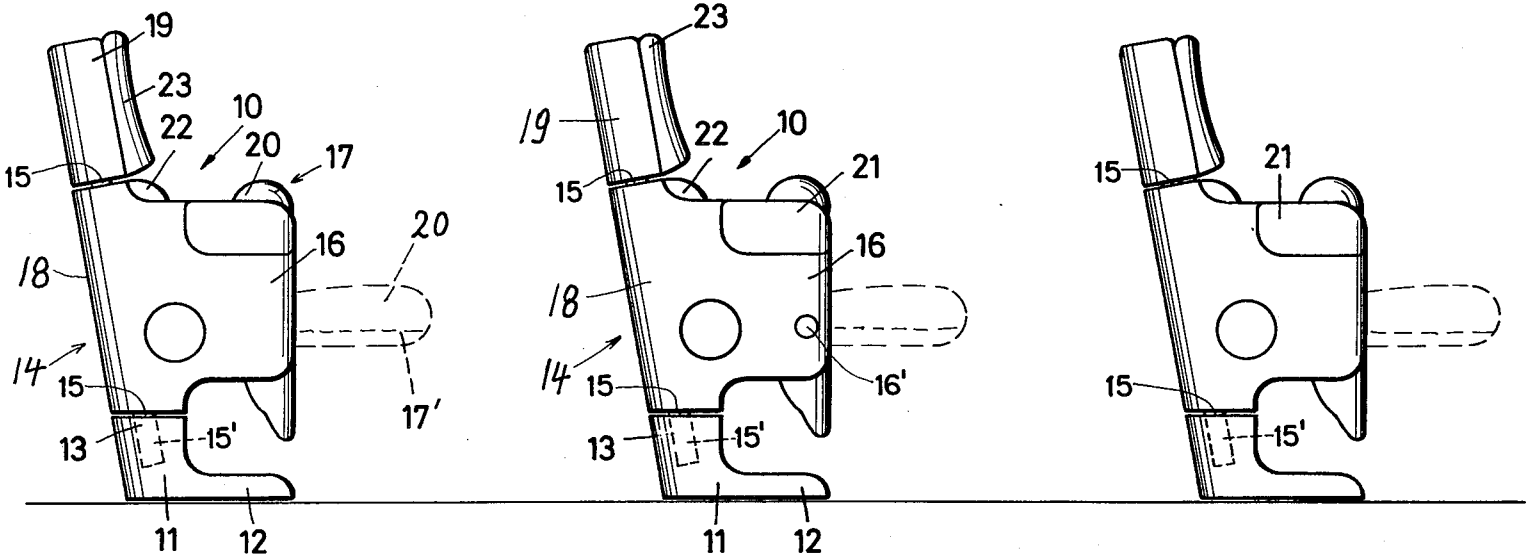
FIG. 1 illustrates a group of three chairs shown in a side elevational view.

DETAILED DESCRIPTION OF EXAMPLE EMBODIMENTS:

Referring first to FIGS. 1 to 4 there are illustrated several groupings of seating furnitures according to the invention. The basic embodiment comprises a chair as it is used in auditoriums which may have a substantially horizontal floor or a floor which rises slightly. The height of the back rest of these chairs is so selected that a free and unimpeded view is provided from all seats.

A chair 10 according to the invention comprises a base member 11 which extends over the entire width of one chair or which may be formed as an integral base for a number of chairs forming a row. The base member 11 comprises a hollow body, such as a box beam or the like, the floor facing side of which extends into a flange or foot 12. The base 11 is secured to the floor by conventional means, such as bolts and nuts or the like, not shown.

The upper side 13 of the base 11 comprises means for securing the center part 14 to the base. For example, the base beam 11 may be provided with a plurality of holes adapted to receive bolts of suitable size. The center part 14 is formed as a shell shaped unit having a rear or back rest wall 18. The center part 14 may comprise in one embodiment two substantially vertically extending columns 15 which support the entire chair structure. The columns 15 may, for example, extend down into corresponding holes 15' in the base 11. The shell shaped center parts 14 are secured to the columns 15 which also carry the forwardly extending side walls 16. The side walls 16 in turn are provided with journal means 16' for a seat member 17. Due to the journal means 16' the seat 17 is foldable in a manner known as such. The center part 14 with its rear wall 18 has also an upper end to which there may be secured a back rest extension or head rest 19.

The seats 17 are padded with cushions 20 covering the top side of the seats 17. The lower surface of each seat 17 may be provided with acoustical insulating means 17' such as styrofoam or the like, for improving the acoustical qualities of an auditorium especially when the latter is not filled to capacity.

The side walls 16 support, preferably in a removable manner arm rest paddings 21. The rear walls 18 of the center parts 14 are provided with means for holding cushion or padding elements 22.

Similarly, the extension of head rest means 19 are also provided with means for releasably holding cushion or padding elements 23.

Figure 3:
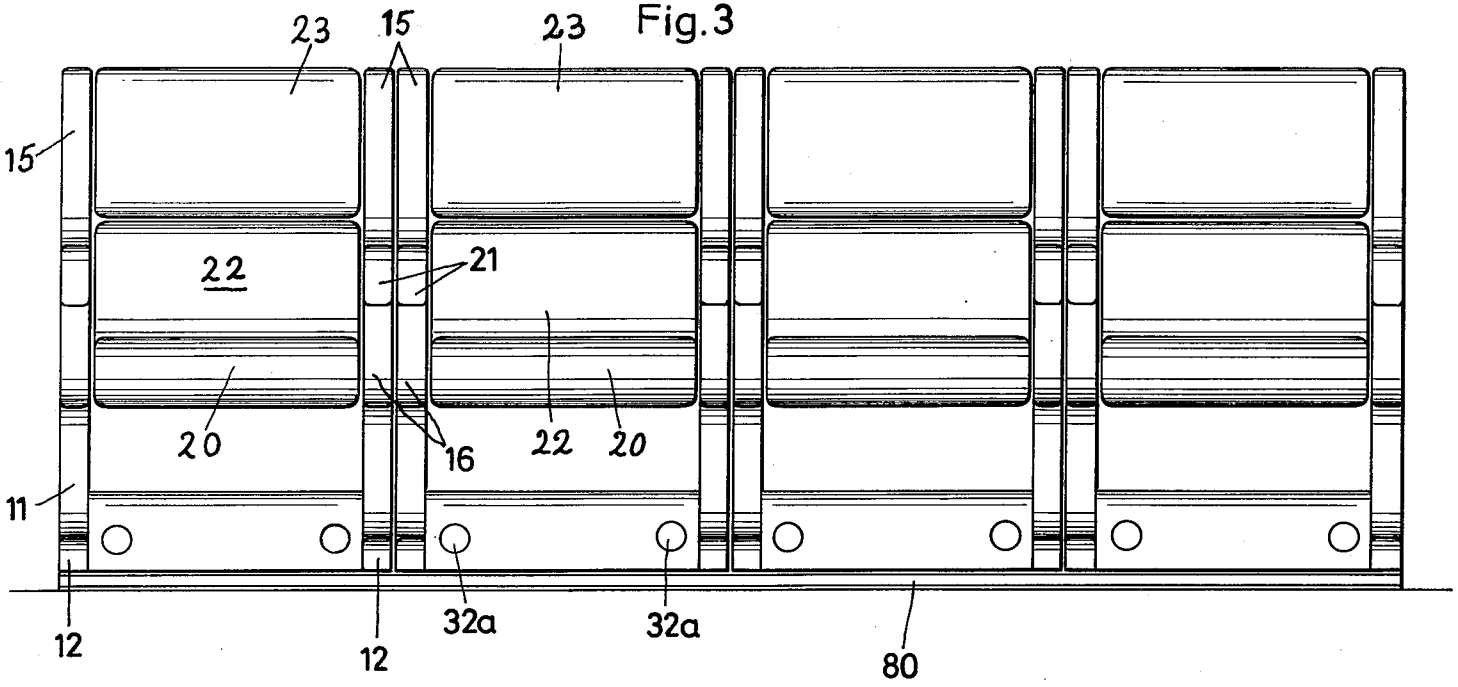
FIG. 3 is a front view of four chairs arranged in a row.

Incidentally, FIG. 3 illustrates a modified embodiment in which four chairs 10 form an integral, portable or transportable unit secured to a common base rail 80. The base rail 80 may be secured to the flooring by any conventional means not shown.

Figure 4:
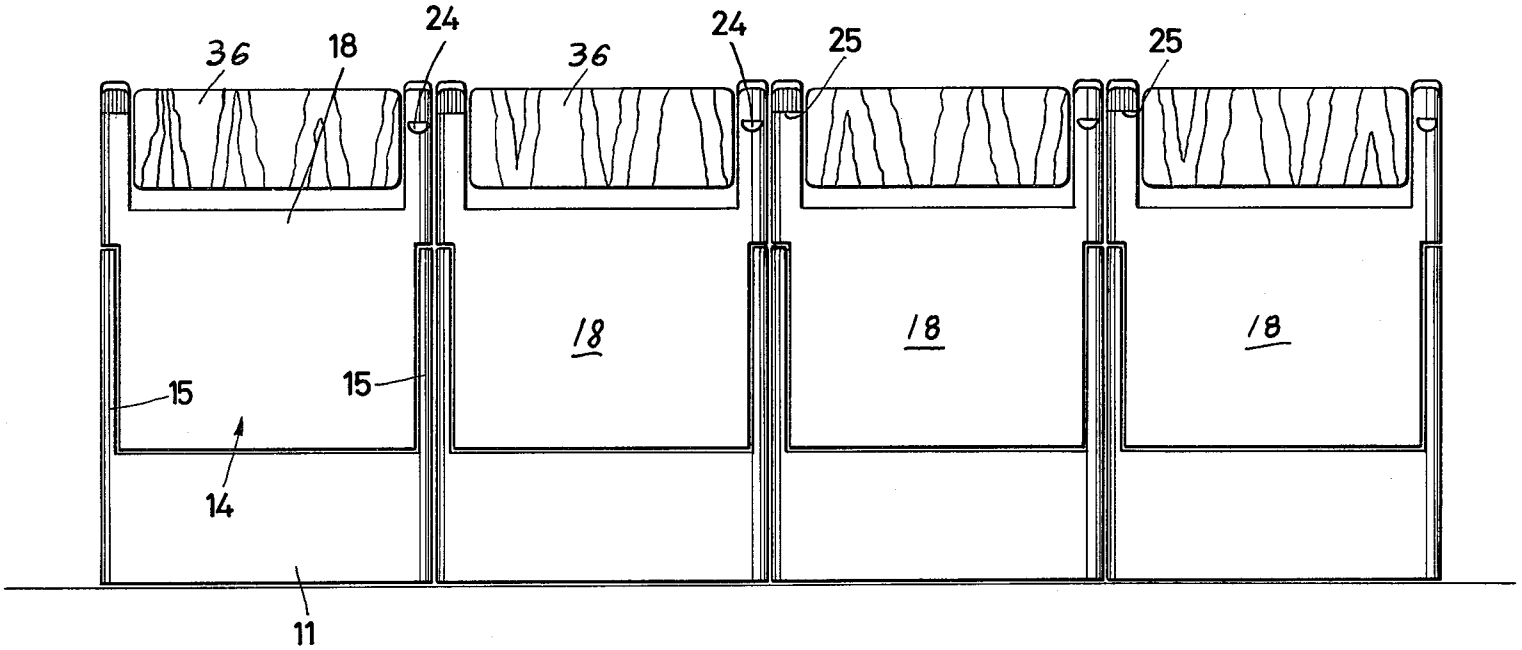
FIG. 4 shows a rear view of a modified embodiment.

FIG. 4 illustrates a rear view of a row of chairs according to the invention, whereby the sides of the head rest extension 19 are provided with removably secured ash trays 24 as well as with light exit openings 25 for electric lights installed inside of the side walls. In embodiments where the columns 15 extend all the way up to the top level of the head rest, the ash trays 24 and/or the lamps 25 may be mounted directly inside these supporting columns 15. Furthermore, the rear walls 18 are provided with recesses in which there are journaled support plates 36 which may form a small writing unit when folded outwardly as shown in dashed lines in FIG. 2.

Figure 5:
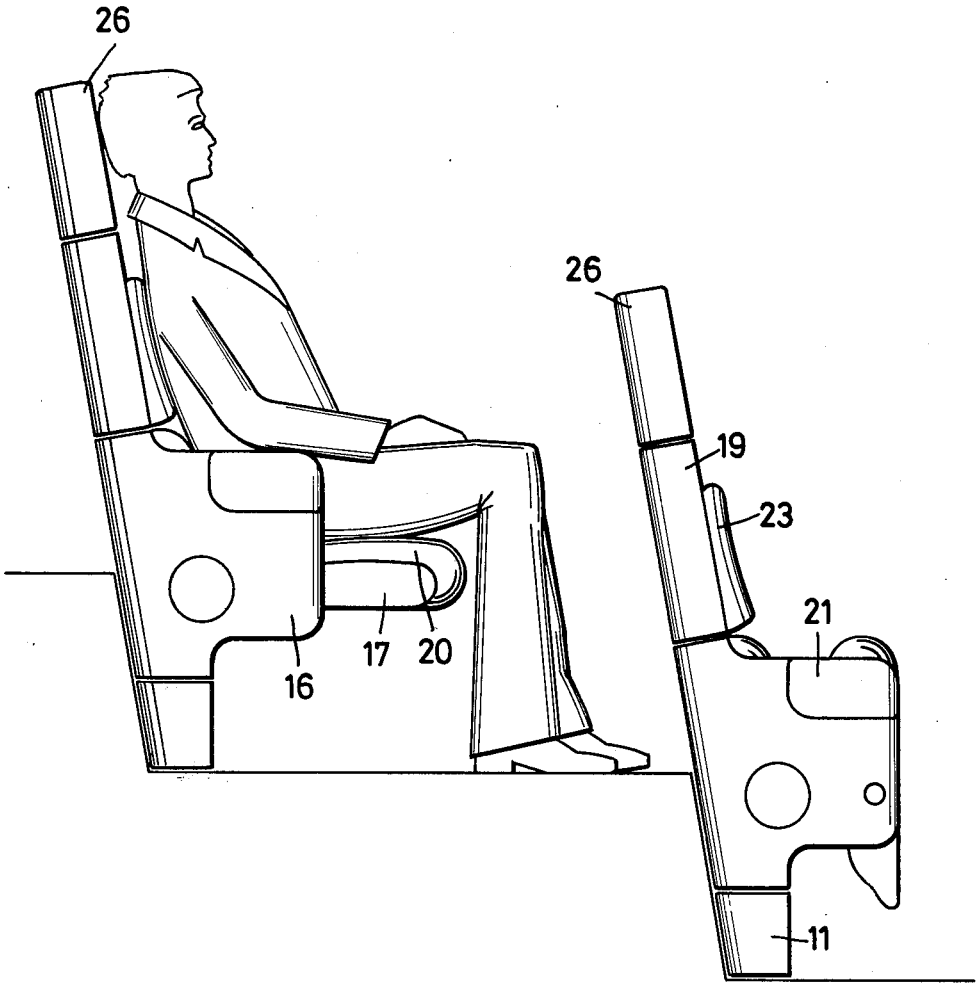
FIG. 5 illustrates a side view of a still further embodiment of a chair arrangement according to the invention.

The embodiment according to FIG. 5 is essentially similar to the just described embodiments, except that in FIG. 5 the more pronounced slanting in a rearward direction modifies the embodiment of FIG. 5 for use on a flooring with a substantial rearward slope which is subdivided into a plurality of stair-step type terraces. Furthermore, due to the more pronounced rearward slope of the embodiment of FIG. 5, a further head rest extension 26 is secured to the upper end of the back rest extension 19.

Figure 6:
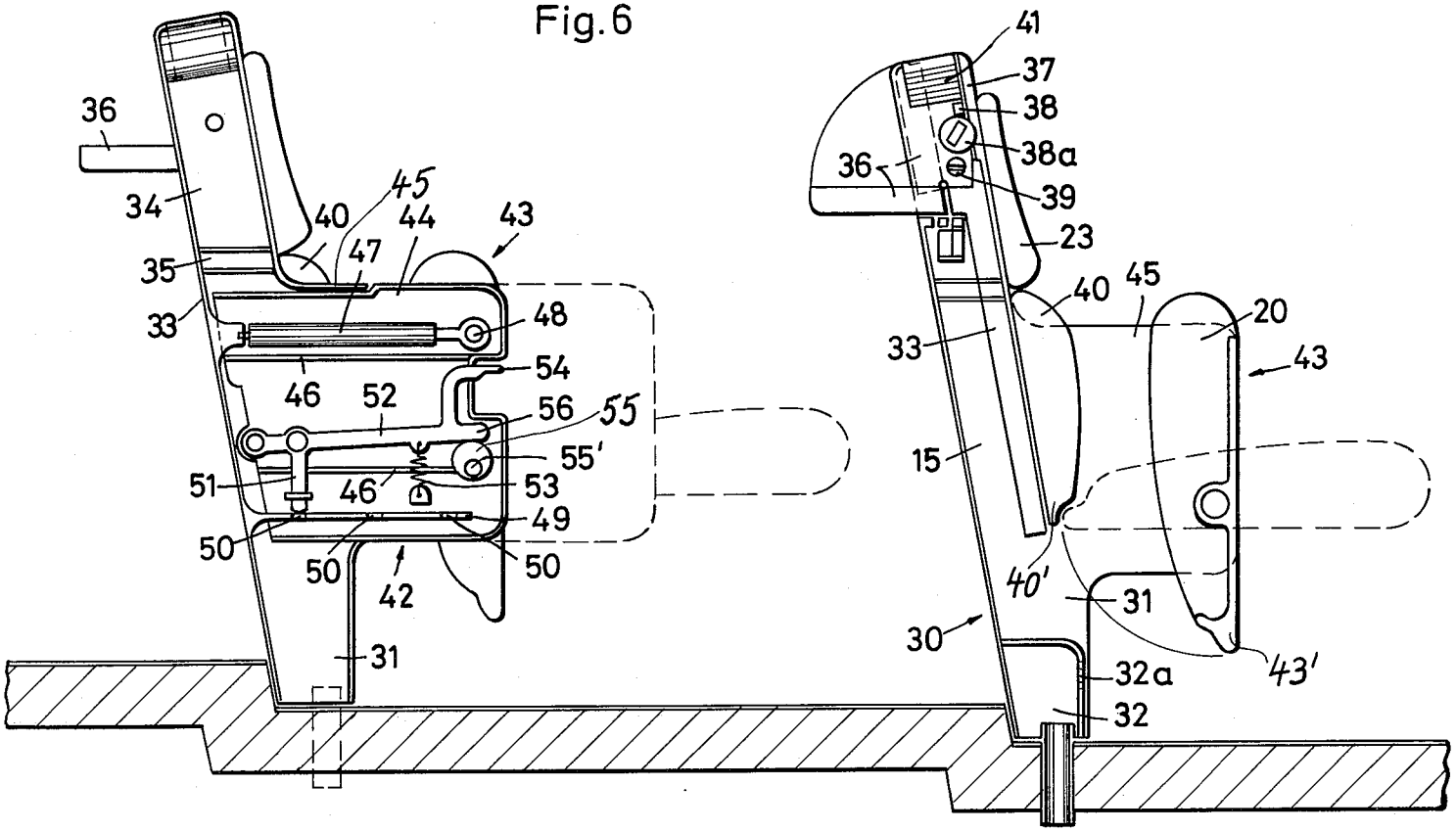
FIG. 6 shows a side view of a group of two chairs with parts partially broken away to show the mechanical elements for the telescoping extension of the side walls of this embodiment.

The embodiment according to FIG. 6 is also provided with a rearwardly foldable relatively small writing surface 36, whereby this particular type of writing support is especially suitable for use in lecture halls, convention halls, and the like, which are also provided with modern communication devices. Basically, the construction of all embodiments is the same as that described above with reference to FIGS. 1 to 4. However, the chairs 30 of FIG. 6 are provided with a base member 31 constructed as an integral channel 32 for several adjacent chairs in a row. The channel 32 is provided with apertures 32*a* which may be employed for heating and/or venting and/or air conditioning purposes. The channels 32 which extend uninterrupted throughout a row of chairs may also contain any electrical wiring, cables or the like.

A spacer member 35 is arranged between the rear portion of the center part 33 and the upper back rest 34 in order to compensate for the elevational difference caused by the rearwardly rising floor, as best seen in FIG. 6. The upper back rest 34 is constructed with a double wall whereby the outer rear wall 36 is hinged or journaled to the remainder of the back rest 34 thereby forming a foldable support plate which, for example, may be used as a writing support. The forward inwardly facing wall portion 37 has attached thereto a terminal block 38 for plugging in a head set plug, for example, forming part of a transmission and translation equipment. Further, switching means 38*a* and 39 may be secured to the wall portion 37 for example, for the channel selection of the transmission and/or translation equipment and for voting purposes. The lighting device 41 is arranged so as to face inwardly thereby providing a better illumination of the writing support plate 36.

FIG. 6 shows in the left-hand portion different elements broken away to expose the mechanism for the horizontal shifting of the chair side walls including the seat proper. The right-hand portion of FIG. 6 shows parts broken away to expose the positioning of the seat proper in a folded up position and in a horizontally extended folded down position. In the embodiment of FIG. 6 the side walls of the chairs comprise a stationary wall portion 45 forming an integral part of the back rest 34 and a movable wall portion 44 arranged for telescoping into and out of the stationary wall portion 45. The full line illustration in FIG. 6 shows the side walls and seat of the chair in the rearmost position, whereas the dashed lines in the left-hand portion of FIG. 6 show the extended position of the side walls and seat 43. The fixed wall portion 45 may also be secured to the upright columns 15 mentioned above. Telescoping guide means 46 known as such are provided for guiding the movable wall portion 44 relative to the fixed wall portion 45. Spring means 47 are connected at the left-hand end thereof to the rear wall 33 of the chair. The right-hand end 48 of the spring means 47 are secured to the telescoping wall portion 44. The spring is biased in such a manner that it tends to return the extended side wall 44 into the rearmost position. The spring return means 47 may also be replaced by hydraulic or pneumatic return means including a piston cylinder arrangement and respective pressure conduits as well as control means to be operated by the user of the seat.

A rail 49 is secured at its rear end for example, to the fixed rear wall of the chair. The rail 49 is provided with a plurality of notches 50 arranged for cooperation with a latch pin 51 extending from a latching lever 52 and urged into these notches or apertures 50 under the force of a spring 53, one end of which is secured to the lever 52 and the other end of which is secured to the movable side wall portion 44. The left-hand end of the lever 52 is pivoted or journaled to the movable wall portion 44. A handle 54 secured to the lever 52 extends out of the front end of the respective movable side wall portion 44 so that the user may disengage the pin 51 from a notch 50 for moving the chair into a different position as shown by the dashed lines.

The seat 43 is supported on a journal shaft 55' carrying at its end an eccenter cam 55 cooperating with an extension 56 of the lever 52. Thus, in response to gravity the seat would tend to take up its upright position as shown in full lines in FIG. 6. As a result, the eccenter cam 55 lifts the lever 52 thereby disengaging the pin 51 from any of the notches 50 and the action of the spring 47 will thus automatically return the seat 43 and with it the side wall 44 into the rearmost position just as soon as the user stands up. This has the advantage that immediately a convenient passage is formed between two adjacent rows of chairs.

Incidentally, the back rest 40 of the center portion 33 is permanently secured to the movable side walls 44 so that it will also move back and forth along with the side walls 44 and the seat 43, which is covered with a conventional padding 20. Further, the lower edge 40' of the back rest 40 is somewhat curved and also reinforced to form a stop for the rearward edge 43' of the seat 43. The rearward edge 43' is preferably a rail of heavy material so as to provide for the above mentioned gravity tendency of the seat to take up its upright position.

Figure 7:
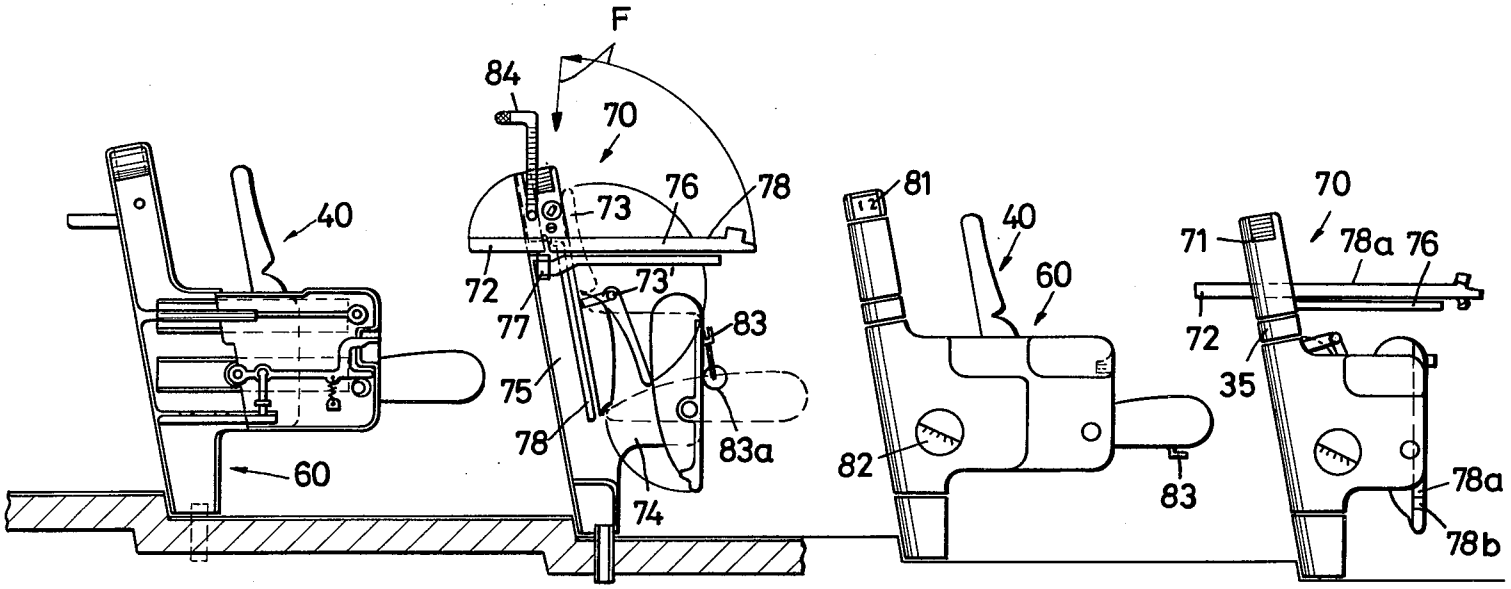
FIG. 7 illustrates a side view of four rows of chairs wherein every other row, namely, the first and third row counted from right to left comprises elements for modifying these rows of chairs into desks.
Figure 8:
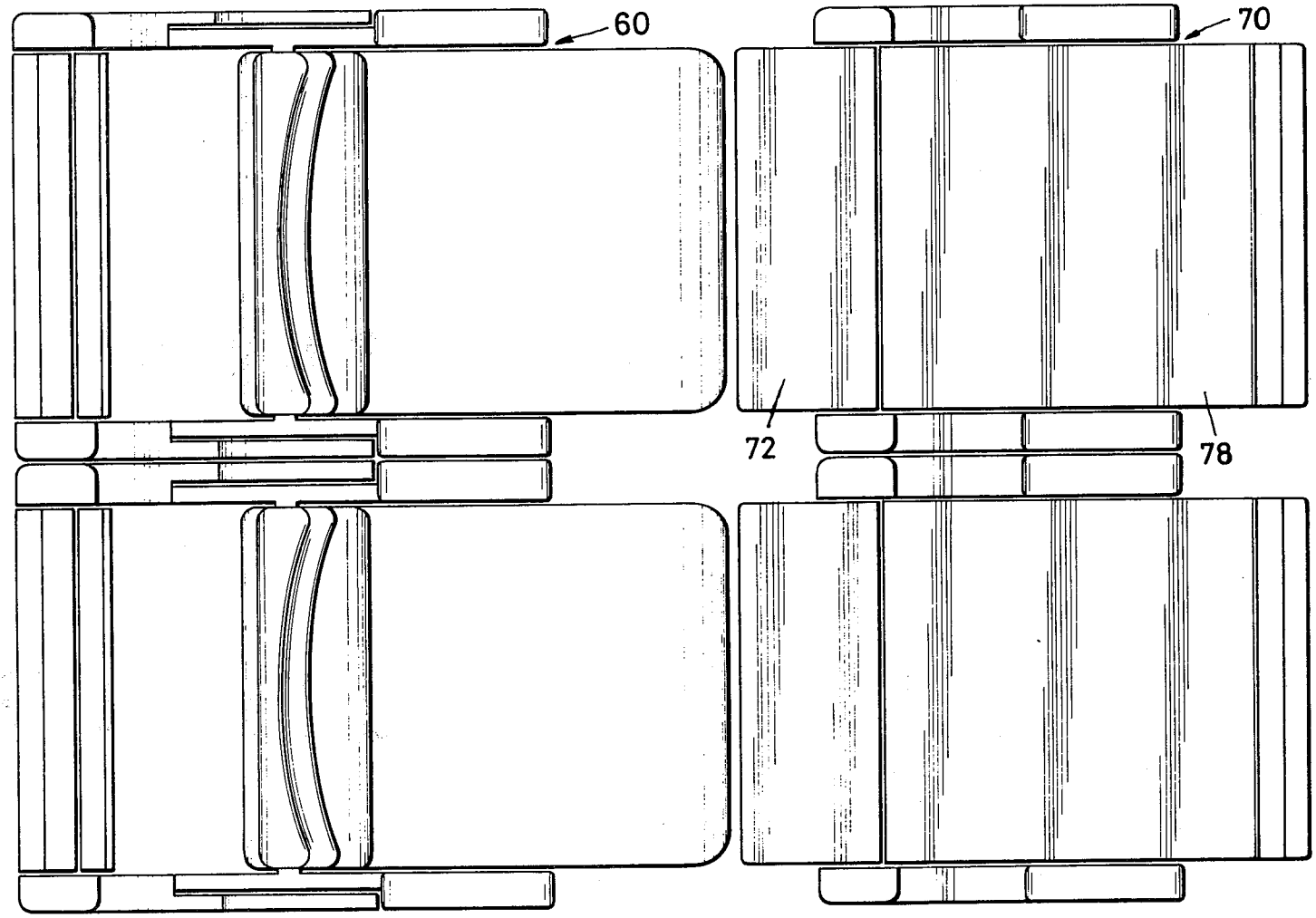
FIG. 8 illustrates a top plan view of a chair grouping substantially as illustrated in FIG. 7, whereby the right-hand row of chairs forms desks for the left-hand row of chairs.

The embodiment illustrated in FIGS. 7 and 8 combines in a grouping two different types of chairs 60 and 70, which alternate with each other from row to row, whereby one row of chairs may be converted into a row of desks for the row of chairs immediately behind the converted row. The convertible rows 70 are basically of the same construction as illustrated in FIGS. 1 to 4 in which the seat is not extendable. Instead, the rows 70 are convertible to provide a rather large desk area. The rows 60 comprise chairs as described above with reference to FIG. 6 so that the seat along with the back rest and side walls of each chair are movable forward closer to the respective desk which may comprise either one continuous desk top or two sections as shown, whereby a section 72 is rearwardly foldable as also illustrated in FIG. 6 with regard to the support panel or plate 36. The electrical wiring and equipment may substantially be the same or similar to that described with reference to the previous embodiments. However, in the embodiment of FIG. 7 the electrical equipment is mounted inside the lateral support columns 75.

Furthermore in the convertible rows 70 the upper head rest 71 is constructed without a front wall portion. Instead, the upper back or head rest 73 is foldable downwardly by hinge means 73'. The hinge means 75' are preferably secured in a releasable manner to the lateral upright column 75, each of which carries near the upper end thereof a bracket 76 tiltable about a bearing 77 into a substantially horizontal, lockable position. In the retracted position both brackets 76 extend downwardly alongside their respective support columns 75 and in parallel to the side walls 74. A desk top 78 is tiltable from a retracted position between the support columns 75 into a substantially horizontal position in which the desk top 78 rests on the brackets 76, please see the third row from the right in FIG. 7. In the rest position the desk top 78 is hidden behind the back rest 73. The rearwardly folding desk portion 72 and the desk top 78 make up a desk area of substantial size when the desk top 78 is in its horizontal position supported by the brackets 76. Such larger work areas are for instance necessary in assembly halls and working conventions.

The embodiment of FIG. 7 illustrates in the first right-hand row 70 a modification in the storing of the desk top **78*a*. In this modification guide means 78*b* are arranged on the underside of the seat to receive the desk top 78*a* when it is not used. The guide 78*b* may be provided with retaining ratchet means or the like for holding the desk top 78*a* in the non-used position underneath the seat. A slight pull enables the removal of the desk top 78*a* from its guide receptacle 78*b*, whereupon it may be placed on the support brackets 76**.

The rows of seats may be numbered as shown at 81 in FIG. 7, whereby preferably the marking 81 comprises a light transmitting plate carrying the respective number and whereby a bulb or the like is located behind the light transmitting plate. In any event, the row numbering and/or seat numbering should be placed at the upper end of the back rest or head rest so as to be easily visible.

Further, seats adjacent to a walkway may be provided with a lighting means 82, for example, to illuminate stairsteps or the like. Such lighting devices 82 may also be connected to an emergency power supply. Further, the underside of the seats may be provided with holding means 83, for example, to hold a head set **83*a*. Furthermore, individual chairs may be equipped with a microphone 84 as shown in FIG. 7, which would be connected to the public address system. Preferably, the microphones will be provided in the row of chairs, which is convertible into a row of desks by moving the desk top 78** in the direction of the arrows F, as explained above.

It is a special advantage of the invention that passageways are easily provided between adjacent rows by the feature of retracting the arm rest side walls along with the seat and with the back rest 40 as best seen in FIG. 7. Furthermore, walkways may be provided between adjacent columns of chairs according to the invention by the feature that the rear walls of the chairs are secured to lateral substantially upright columns in a releasable manner. Thus, the back walls of the chairs may also be removed from the supporting columns and the seat with the side walls and back rest may also be removed whereby longitudinal passageways between adjacent chair columns may be provided, if desired.

In view of the above it will be appreciated that the chairs of the present invention may easily be varied for different purposes and the several variations may be combined with each other, for example, to accommodate a floor area having a substantial slope or rise, Further, these variations may be accomplished with a minimum of elements. Thus, although only a few embodiments have been illustrated and described, it will be appreciated that it is intended to cover all modifications and equivalents within the scope of the appended claims.

What is claimed is:

1. A seating furniture comprising base means, right and left lateral side wall means including rear edges and lower edges, said lower edges being secured to said base means, two substantially upright column means secured to said base means and respectively to said rear edges and said lateral side wall means, seat means proper, back rest means including a first part and a second part, each of said lateral side wall means comprising a first side wall member secured to its respective column means, a second side wall member, and guide means securing said second side wall member to said first side wall member in telescoping fashion to forwardly extend said second side wall member, said guide means taking up static forces, said second part of the back rest means forming a structural unit with said second said wall member, said column means having upper ends above said second part of said back rest means, said first part of said back rest means interconnecting said columns, journal means securing said seat means proper to said second side wall member, and electrical means in at least one of said substantially upright column means.

2. The seating furniture according to claim 1, wherein said structural unit of said second back rest part and said lateral side wall means has a shell shape forming an integral structure secured to said column means.

3. The seating furniture according to claim 1, further comprising head rest means having the same shell shape configuration as said second back rest part and said first back rest part, said head rest means also being secured to said upright column means and thus to said back rest to form an upward extension of said back rest means.

4. The seating furniture according to claim 1, wherein said back rest means comprises a rear wall element hinged to said back rest to form a support table or desk in its unfolded condition.

5. The seating furniture according to claim 1, wherein said back rest comprises a recess adapted to receive support table or desk means, and support elements carried by said substantially upright columns for supporting in a hinged manner said table or desk means in said recess.

6. The seating furniture according to claim 1, further comprising multiple position locking means for said telescoping second side wall member whereby said telescoping second side wall member is arrestable in any one of a number of positions.

7. The seating furniture according to claim 1, wherein said first and second side wall members comprise hollow spaces, said furniture further comprising return means operatively secured to said second side wall member in said hollow spaces, and to said substantially upright column means for urging said second side wall member into a retracted position.

8. The seating furniture according to claim 1, wherein said seat means proper comprise sound damping means secured to an under surface of said seat means proper.

9. The seating furniture according to claim 1, further comprising cushion means secured to the second part of said back rest means, said cushion means comprising a rigid lower edge, said seat means proper comprising a rigid rear edge arranged to rest against said rigid lower edge of the cushion means forming a stop for the seat means when the latter is in its downfolded position.

10. The seating furniture according to claim 1, further comprising means latching said seat means against unintended downfolding.

11. The seating furniture according to claim 1, further comprising cross connecting means interconnecting a plurality of said base means in a row to form a portable seating unit.

12. The seating furniture according to claim 11, wherein said cross connecting means comprise a channel beam to which the base means are secured, said channel beam having a plurality of apertures along its length.

13. The seating furniture according to claim 1, further comprising electrical terminal means operatively secured to said back rest means.

14. The seating furniture according to claim 1, further comprising ash tray means mounted in at least one of said columns.

15. The seating furniture according to claim 1, further comprising holding means secured to an underside of said seat means proper and adapted to hold a head set or earphone.

16. The seating furniture according to claim 1, further comprising microphone means mounted to the upper end of at least one of said substantially upright column means.

17. The seating furniture according to claim 1, further comprising seat marking means mounted to the upper end of at least one of said substantially upright column means.

18. A seating furniture comprising base means, right and left lateral side wall means including rear sides and lower sides, said lower sides being secured to said base means, two substantially upright column means secured to said base means and respectively to said rear sides of said lateral side wall means, seat means proper, back rest means including a lower part and an upper part, said lower part of the back rest means forming a structural unit with said lateral side wall means, said column means having upper ends above said lower part of said back rest means, said upper part of said back rest means interconnecting said upper ends of said columns, journal means securing said seat means proper to said side wall means, and electrical means in at least one of said substantially upright column means, and further comprising means connected to said seat means proper at the lower surface thereof for releasably holding a desk or table top.

19. A seating furniture comprising base means, right and left lateral side wall means including rear sides and lower sides, said lower sides being secured to said base means, two substantially upright column means secured to said base means and respectively to said rear sides of said lateral side wall means, seat means proper, back rest means including a lower part and an upper part, said lower part of the back rest means forming a structural unit with said lateral side wall means, said column means having upper ends above said lower part of said back rest means, said upper part of said back rest means interconnecting said upper ends of said columns, journal means securing said seat means proper to said side wall means, and electrical means in at least one of said substantially upright column means, said seating furniture comprising at least two chairs including a front chair and a rear chair, said front chair comprising desk means including a desk top for converting the front chair into a desk unit for the rear chair, whereby said desk top extends between said substantially upright column means.

20. A seating furniture comprising base means, right and left lateral side wall means including rear sides and lower sides, said lower sides being secured to said base means, two substantially upright column means secured to said base means and respectively to said rear sides of said lateral side wall means, seat means proper, back rest means including a lower part and an upper part, said lower part of the back rest means forming a structural unit with said lateral side wall means, said column means having upper ends above said lower part of said back rest means, said upper part of said back rest means interconnecting said upper ends of said columns, journal means securing said seat means proper to said side wall means, and electrical means in at least one of said substantially upright column means, said seating furniture comprising means removably securing said seat means proper to said side wall means, and means releasably securing said back rest means to said substantially upright column means, whereby an aisle may be formed between adjacent columns of chairs.

21. A seating furniture comprising first and second fixed spaced apart side walls and including a fixed back portion, a middle portion suspended for horizontal sliding movement between said side walls and comprising first and second spaced apart arm rests, a back rest and a seat, said seat being pivotally mounted on a horizontal axis in said middle portion, and a rearwardly foldable writing surface pivotally mounted between said side walls.

22. The seating furniture of claim 21 further comprising a pair of fixed spaced apart generally vertically extending columns, said side walls being affixed to said columns.

23. The seating furniture of claim 21, wherein said side walls comprise horizontally extending guide means, said arm rests being mounted to telescope into said guide means, and further comprising spring means biasing said middle portions toward said fixed back portion, said position setting means positioned to selectively releasably hold said middle portion at determined displacements from said back portion.

24. The seating furniture of claim 23, wherein said middle portion further comprises means responsive to an upright position of said seat for releasing said position setting means, for thereby automatically retracting said middle portion toward said fixed back portion.

25. The seating furniture of claim 21, wherein the rear edge of said seat is weighted, whereby said seat assumes a vertical position when not in use.

26. The seating furniture of claim 21, wherein said side walls extend to the top of said furniture and further comprising an upper back rest portion extending between the upper portions of said side walls, said side walls and upper back rest portion thereby defining a recess into which said foldable writing surface may be pivoted, and further comprising electric light means in the upper portions of said side walls for illuminating said foldable writing surface.

27. A seating system comprising a plurality of rows of chairs, at least one of said chairs comprising fixed spaced apart side walls, and a middle portion suspended for horizontal sliding movement between said side walls, said middle portion comprising first and second spaced apart arm rests, a back rest and a seat, said seat being pivotally mounted on a horizontal axis in said middle portion.

28. The system of claim 27, wherein a chair in front of said one chair comprises spaced apart supporting side walls, and means mounting a writing surface between the side walls of said front chair.

29. The system of claim 28, wherein said front chair has an upper back rest portion pivotally mounted between the side wall thereof to be moved forwardly with respect to said front chair.

30. The seating system of claim 29 comprising bracket means removably extendable from the upper portions of said side walls in the forward direction of said front chair, and writing table means removably held on said bracket means.

31. The system of claim 30, further comprising recess means behind said foldable back rests for storing said table means.

32. The system of claim 30, wherein said front chair has a pivoted seat, and further comprising means under said pivoted seat for storing said table means.

* * * * *

UNITED STATES PATENT OFFICE
CERTIFICATE OF CORRECTION

Patent No. 4,072,346 Dated February 7, 1978

Inventor(s) Ralf Schueler

It is certified that error appears in the above-identified patent and that said Letters Patent are hereby corrected as shown below:

Column 6, line 38, "and" should be --of--.

Column 6, line 47, "said" (second occurrence) should be --side--.

Column 8, line 68 "said" should be --and--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*